US012379185B2

(12) United States Patent
Smathers et al.

(10) Patent No.: US 12,379,185 B2
(45) **Date of Patent: *Aug. 5, 2025**

(54) MODULAR FIREARM BLOCK

(71) Applicant: OA DEFENSE LLC, Dayton, NV (US)

(72) Inventors: Joseph Smathers, Dayton, NV (US); Todd Powers, Dayton, NV (US)

(73) Assignee: OA DEFENSE LLC, Dayton, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/228,363

(22) Filed: Jul. 31, 2023

(65) Prior Publication Data

US 2025/0044058 A1 Feb. 6, 2025

(51) Int. Cl.

| | |
|---|---|
| ***F41G 1/02*** | (2006.01) |
| ***F41A 19/10*** | (2006.01) |
| ***F41A 19/38*** | (2006.01) |
| ***F41A 19/53*** | (2006.01) |
| ***F41C 3/00*** | (2006.01) |
| ***F41C 23/10*** | (2006.01) |

(52) U.S. Cl.

CPC ..... *F41G 1/02* (2013.01); *F41A 19/10* (2013.01); *F41A 19/38* (2013.01); *F41A 19/53* (2013.01); *F41C 3/00* (2013.01); *F41C 23/10* (2013.01)

(58) Field of Classification Search

CPC ..... F41G 1/02; F41G 1/033

See application file for complete search history.

(56) References Cited

U.S. PATENT DOCUMENTS

| | | | | |
|---|---|---|---|---|
| 984,519 | A | 2/1911 | Browning | |
| 1,410,266 | A | 3/1922 | Pedersen | |
| 3,365,829 | A * | 1/1968 | Shockey | F41C 27/22 42/97 |
| 3,682,040 | A | 8/1972 | Roy | |
| 4,023,296 | A | 5/1977 | Frisoli | |
| 4,338,740 | A | 7/1982 | Miller | |
| 4,539,770 | A | 9/1985 | Bornancini | |
| 4,593,487 | A | 6/1986 | Ruger | |
| 4,709,497 | A | 12/1987 | Resca | |
| 6,116,137 | A | 9/2000 | Strahan | |
| 6,205,694 | B1 | 3/2001 | Davis | |
| 9,068,790 | B2 | 6/2015 | La Vigne | |
| 10,000,000 | B2 | 6/2018 | Marron | |
| 10,794,648 | B2 | 10/2020 | Henninger et al. | |
| 11,287,216 | B2 * | 3/2022 | Padovan | F41G 1/033 |
| 11,874,078 | B2 * | 1/2024 | Roe | F41A 21/325 |
| 12,007,199 | B2 * | 6/2024 | Smathers | F41C 23/10 |
| 2012/0117841 | A1 | 5/2012 | Joubert | |
| 2013/0269233 | A1 | 10/2013 | Chin | |

(Continued)

FOREIGN PATENT DOCUMENTS

WO 2018102458 A2 11/2017

OTHER PUBLICATIONS

International Search Report and Written Opinion dated Oct. 19, 2023 issued in PCT/US2023/29136.

*Primary Examiner* — Reginald S Tillman, Jr.
(74) *Attorney, Agent, or Firm* — HUNTON ANDREWS KURTH LLP

(57) ABSTRACT

A modular firearm block that can attach to the frame of a firearm. The block can have a member that can attach to a recess on the frame. The block can also have holes for a pin and a pin connector which also attach the block to the frame of the firearm.

20 Claims, 4 Drawing Sheets

(56) References Cited

U.S. PATENT DOCUMENTS

| | | | |
|---|---|---|---|
| 2018/0058792 | A1 | 1/2018 | Schirmer |
| 2019/0041150 | A1 | 2/2019 | Lopata et al. |
| 2019/0137206 | A1 | 5/2019 | Lopata |
| 2020/0025501 | A1 | 1/2020 | Price |
| 2021/0131764 | A1 | 5/2021 | Padovan |

* cited by examiner

MODULAR FIREARM BLOCK

CROSS-REFERENCE TO RELATED APPLICATIONS

This application relates to U.S. Pat. No. 984,519 filed on Feb. 17, 1910, the contents of which are incorporated herein in its entirety.

FIELD OF THE DISCLOSURE

The present disclosure relates to a firearm block that can be modularly assembled and disassembled onto a firearm frame.

BACKGROUND

Hand pistols taught by U.S. Pat. No. 984,519, or some variation thereof, (each a "1911") have been in production for over one-hundred years. During that time, the 1911 has developed a loyal following for a variety of reasons. Unfortunately, the front sight on the 1911 is on the slide, which moves during firing. Thus, aiming is made more difficult. It would be beneficial to provide a firearm with a front sight that could be stationary during firing.

SUMMARY OF THE DISCLOSURE

In some aspects, the techniques described herein relate to a firearm including: a frame including a block member recess and a pin connector member recess; a barrel; a slide; and a sight block including: a block member configured to removably attach to the block member recess; a barrel hole; a pin hole below the barrel hole; a pin connector hole running through the member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

In some aspects, the techniques described herein relate to a firearm including: a frame including a block member recess and a pin connector recess; a sight block including: a block member configured to removably attach to the block member recess; a barrel hole; a pin hole below the barrel hole; a pin connector hole running through the block member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

In some aspects, the techniques described herein relate to a sight block including: a block member configured to removably attach to a block member recess in a firearm frame; a barrel hole; a pin hole below the barrel hole; a pin connector hole running through the block member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

Further features of the disclosed systems and methods, and the advantages offered thereby, are explained in greater detail hereinafter with reference to specific example embodiments illustrated in the accompanying drawings.

BRIEF DESCRIPTION OF THE DRAWINGS

In order to facilitate a fuller understanding of the present invention, reference is now made to the attached drawings. The drawings should not be construed as limiting the present invention, but are intended only to illustrate different aspects and embodiments of the invention.

DETAILED DESCRIPTION

Figure 1A:
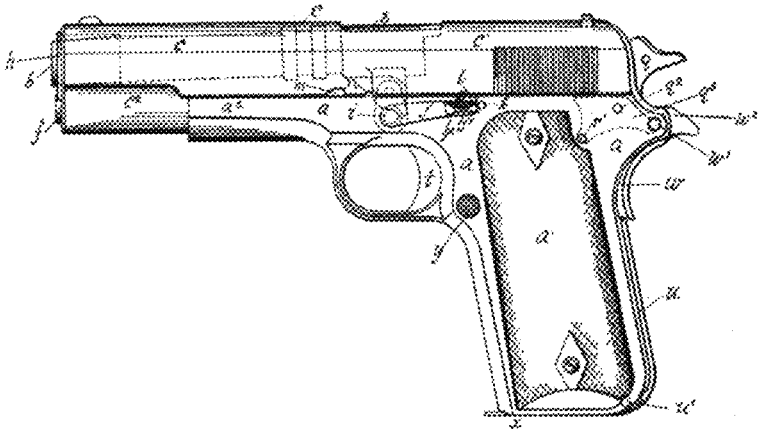
FIG. 1A is side view of a hand pistol of the prior art, the image taken from U.S. Pat. No. 984,519 (FIG. 1), the pistol shown in a rest configuration.

Exemplary embodiments of the invention will now be described in order to illustrate various features of the invention. The embodiments described herein are not intended to be limiting as to the scope of the invention, but rather are intended to provide examples of the components, use, and operation of the invention.

Furthermore, the described features, advantages, and characteristics of the embodiments may be combined in any suitable manner. One skilled in the relevant art will recognize that the embodiments may be practiced without one or more of the specific features or advantages of an embodiment. In other instances, additional features and advantages may be recognized in certain embodiments that may not be present in all embodiments.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The following description relates to a modular firearm block that is can be removably attached to the frame of a firearm, e.g. the frame of a handgun. The firearm block can be attached to the frame via one or more attachment mechanisms such as a pin and pin connector. Also, the block can be configured to mate with the frame via a dovetail attachment mechanism or some other suitable mating mechanism. In an exemplary situation, the user can assemble the barrel and slide to the frame of the firearm. Then, after pulling back the slide, the user can attach the block to the frame of the gun via the attachment mechanisms. Thus, the block is fully modular.

The modular block offers a stationary sight while the firearm is firing or cycling, thus improving the aim of the user. Furthermore, the pin and pin connectors (as well as the dovetail configuration) make the block easy to assemble and disassemble from the firearm. Thus, the user can much more quickly release the front system and swap out other modular blocks, clean the firearm, or other action that requires partial or complete disassembly.

Additionally, the modular block can act not only as a stationary sight, but also as a muzzle brake. That is, the modular block can reduce recoil and control muzzle rise during firing. It can redirect and manage the gases that are expelled from the barrel when a round is fired, thereby mitigating the effects of recoil on the shooter. Such muzzle braking is particularly useful for competition pistols, where fast follow-up shots and recoil management are crucial for performance. Regardless, the modular block can mitigate recoil in any shooting situation. Furthermore, the modular block can address muzzle rise and flip. Muzzle rise occurs when the front of the handgun rises during firing due to the recoil forces. This can make it challenging to maintain sight alignment and sight picture for follow-up shots. A compensator's design directs the expelled gases in a way that counteracts the upward motion of the muzzle, keeping the firearm more stable during rapid fire and enabling quicker target reacquisition. Although not illustrated in the figures, it is understood that some embodiments of the modular block can include ports specifically designed to manage the escape of gases while firing. Furthermore, the frame of the handgun in the following embodiments is configured to receive multiple different modular blocks. This would be useful in situations where the shooter would like to switch out modular blocks for competitions or for aesthetic purposes.

FIG. 1A is side view of a hand pistol of the prior art, the image taken from U.S. Pat. No. 984,519 (FIG. 1), the pistol shown in a rest configuration.

Figure 1B:
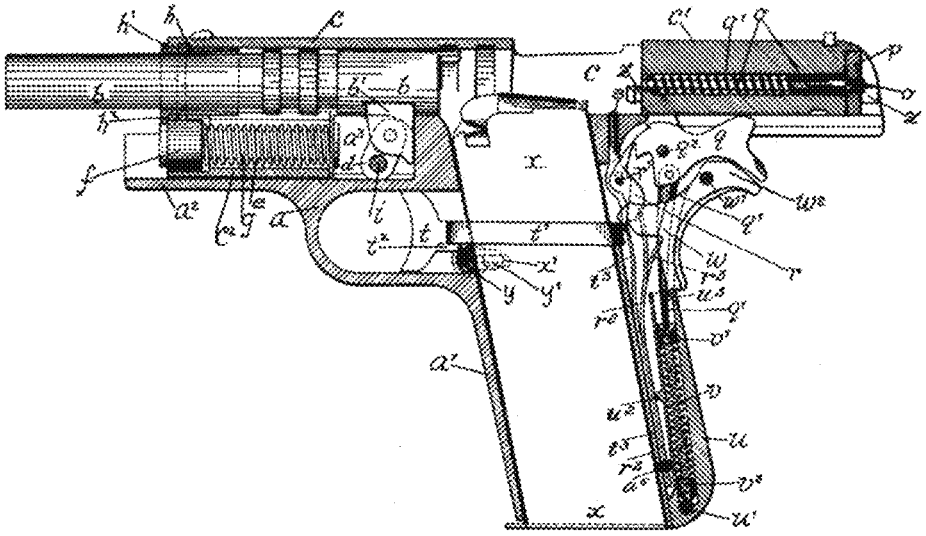
FIG. 1B shows the pistol of FIG. 1A in a loading configuration, a portion of the pistol removed to show internal components thereof.

FIG. 1B shows the pistol of FIG. 1A in a loading configuration, a portion of the pistol removed to show internal components thereof.

Figure 2:
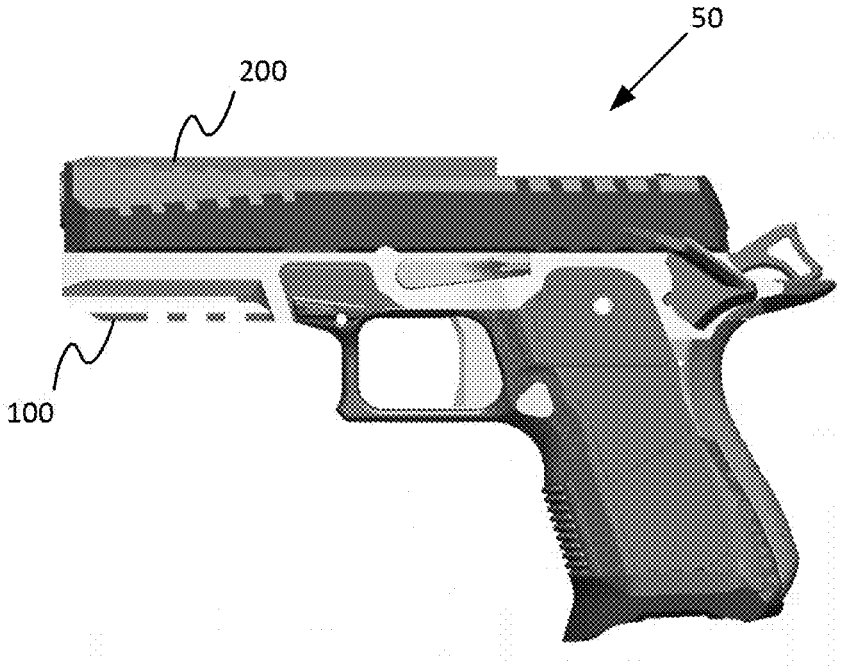
FIG. 2 is a diagram of a firearm according to an exemplary embodiment.

FIG. 2 is a diagram of a firearm 50 according to an exemplary embodiment. The firearm 50 can include a frame 100 and a slide 200, as well as other element not shown or labeled such as barrel; slide; hammer; firing pin; safety; magazine; magazine spring; sear; sear spring; firing pin block; grip; sights; ejection port; slide stop; extractor; and trigger guard. Beneath the slide is the block 300 as described in FIGS. 3A-3C and 4A-4C.

Figure 3A:
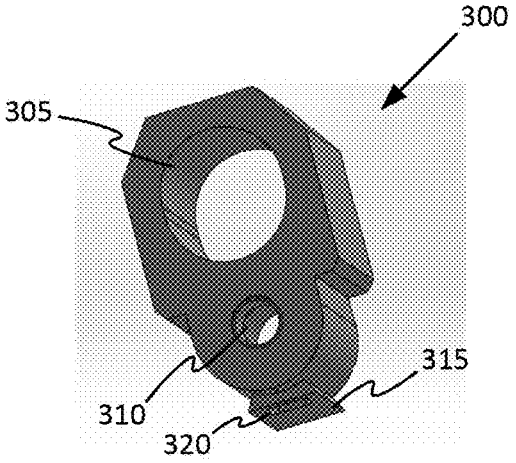
FIGS. 3A, 3B, and 3C illustrate a modular sight block according to an exemplary embodiment.
Figure 3B:
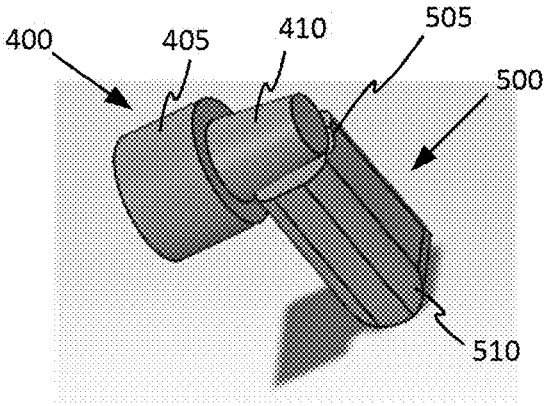
Figure 3C:
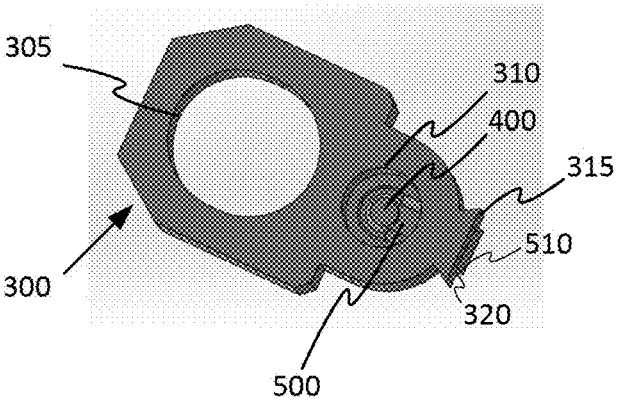

FIGS. 3A, 3B, and 3C illustrate a modular sight block 300 according to an exemplary embodiment. FIG. 3A is a perspective view of the sight block 300. The block 300 can include a barrel hole 305 which can match the size and shape of the barrel or otherwise be suitably sized for the barrel of the firearm. Below the barrel hole 305 is the pin hole 310. The pin hole 310 can be smaller than the barrel hole 305 and threaded for engagement with the pin 400. The block 300 can also have a member 315 on the lower portion of the block 300, i.e. the portion below the barrel hole 305 and the pin hole 310. The member 315 can be designed like a dovetail so that it can fit snugly with a corresponding member recess on the frame 100. Running from the member 315 into the pin hole 310 is a pin connector hole 320. The pin connector hole 320 can be shaped and sized to fit the pin connector 500.

Regarding FIG. 3B, the block 300 can be engaged with a pin 400 and a pin connector 500. The pin 400 can be any suitable attachment mechanism such as a screw, thread, rod, or pin. The pin 400 may be threaded to removably attached with a correspondingly threaded pin connector 500. The pin 400 may have a pin head 405 and pin body 410. The pin head 405 can have a recess suitable for using a screwdriver or some other driving member to attach the pin 400 to the pin connector member 510. The pin body 410 can be threaded to fit the pin connector 500 via the pin body recess. The pin connector 500 can be threaded through the pin connector hole 320 such that the pin body recess 505 sits within the pin hole 310 and the pin connector member 510 extends past the pin connector hole 320 such that the pin connector member 510 can removably attach to the pin connector member recess as illustrated in FIG. 4A.

Regarding FIG. 3C, the block 300 can engage with the pin 400 and the pin connector 500 such that the pin 400 removably attaches to the pin connector 500 within the pin hole 310. Once connected with the pin 400, the pin connector member 510 extends past the pin connector hole 320 out of the member 315.

Figure 4A:
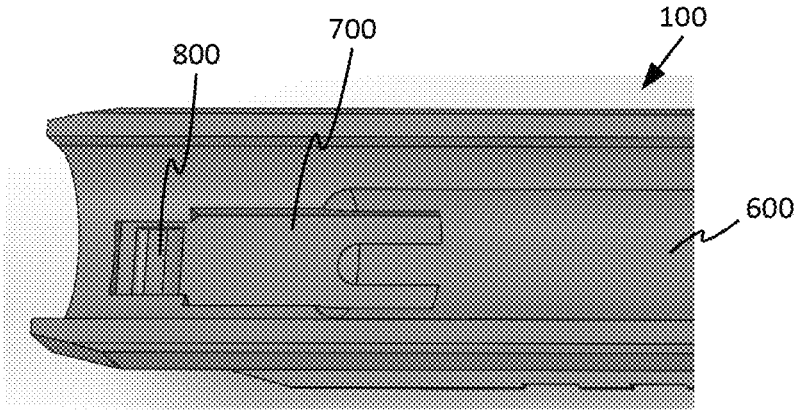
FIGS. 4A, 4B, and 4C illustrate a firearm frame with and without a modular sight block according to an exemplary embodiment.
Figure 4B:
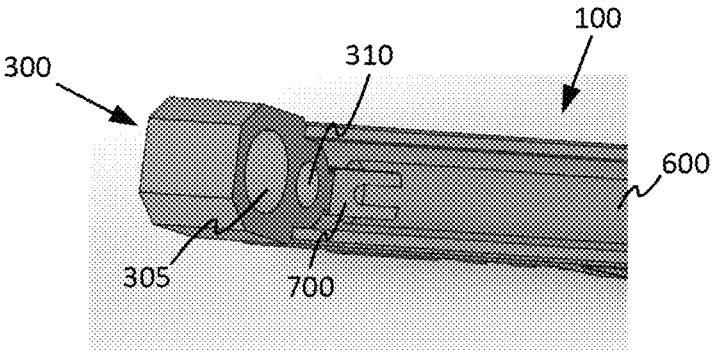
Figure 4C:
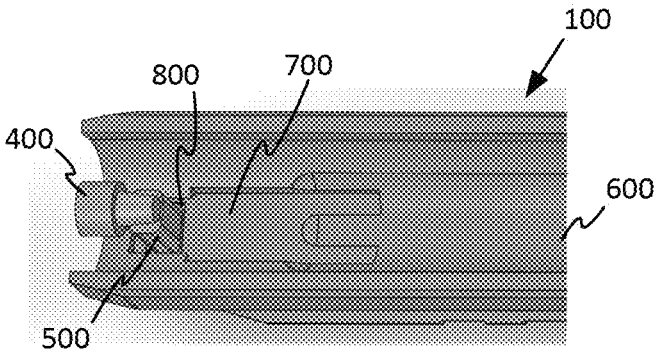

FIGS. 4A, 4B, and 4C illustrate a firearm frame with and without a modular sight block according to an exemplary embodiment.

Regarding FIG. 4A, the frame 100 can include a barrel recess 600 extending along the portion of the frame 100 where the barrel of a conventional 1911 would sit. Overlapping with the barrel recess 600 is the block member recess 700 designed to receive or mate with the block member 315. In some embodiments, the block member 315 and the block member recess 700 can be designed to have a dovetail configuration such that the block member 315 can dovetail or slide into the block member recess 700 such that the block member 315 is mated and removably attached to the frame 100. Within the block member recess 700 is a pin connector member recess 800 which is designed to receive the pin connector member 510. In one embodiment, the pin connector member 510 once mated with the pin connector member recess 800 will provide further stability to the attachment between the block 300 and the frame 100.

Regarding FIG. 4B, the block 300 can be removably attached to the block member recess 700 on the frame 100. Although not pictured in FIG. 4B, it is understood that the pin 400 and the pin connector 500 can be attached to the block 300 via the pin hole 310.

Regarding FIG. 4C, the diagram shows how the pin 400 and the pin connector 500 would appear on the frame 100 without the block 300. This diagram is not meant to show an embodiment, but rather how the pin 400 and the pin connector 500 would attach to the frame 100 without the block 300 obstructing the view.

In some aspects, the techniques described herein relate to a firearm including: a frame including a block member recess and a pin connector member recess; a barrel; a slide; and a sight block including: a block member configured to removably attach to the block member recess; a barrel hole; a pin hole below the barrel hole; a pin connector hole running through the member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

In some aspects, the techniques described herein relate to a firearm, wherein the pin is a threaded screw, bolt, or rod. In this aspect, the pin used to attach the modular sight block to the firearm is designed as a threaded screw, bolt, or rod. The threading allows for a secure and removable attachment of the pin to the pin connector. This threaded pin provides a reliable and robust connection between the sight block and the firearm frame. A threaded bolt pin could be used in this aspect. It would have a threaded body that matches the threading inside the pin connector hole of the sight block. The bolt pin could be inserted through the pin hole in the sight block and screwed into the pin connector, ensuring a tight and secure attachment.

In some aspects, the techniques described herein relate to a firearm, wherein the pin connector is threaded to receive the pin. This aspect pertains to the pin connector, which is the component that receives and engages with the threaded pin to attach the sight block. The pin connector itself is designed with threading that matches the pin, allowing the two to be screwed together. This threaded connection ensures a firm and stable attachment between the sight block and the firearm frame. For example, pin connector could be a cylindrical component with internal threading that corresponds to the threading on the pin. When the pin is inserted into the pin connector hole of the sight block, the pin connector is screwed onto the pin, securely fastening the sight block to the firearm frame.

In some aspects, the techniques described herein relate to a firearm, wherein the pin includes a pin head and a pin body, wherein the pin head can be operably engaged with a screwdriver. For example, the pin could be designed with a pin head that has a recessed slot or a suitable shape for accommodating a screwdriver. This allows the user to tighten or loosen the pin using a screwdriver, providing a straightforward method for attaching or removing the sight block.

In some aspects, the techniques described herein relate to a firearm, wherein the sight block is configured to be covered by the slide while firearm is assembled but not firing.

In some aspects, the techniques described herein relate to a firearm, wherein the sight block is configured to remain in a fixed position while the firearm is firing.

In some aspects, the techniques described herein relate to a firearm, wherein the sight block has beveled edges.

In some aspects, the techniques described herein relate to a firearm, wherein the sight block has rounded edges.

In some aspects, the techniques described herein relate to a firearm, wherein the sight block is included of at least one selected from the group of steel, polymer, and carbon fiber.

In some aspects, the techniques described herein relate to a firearm including: a frame including a block member recess and a pin connector recess; a sight block including: a block member configured to removably attach to the block member recess; a barrel hole; a pin hole below the barrel hole; a pin connector hole running through the block member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

In some aspects, the techniques described herein relate to a firearm, wherein the pin is a threaded screw, bolt, or rod.

In some aspects, the techniques described herein relate to a firearm, wherein the pin connector is threaded to receive the pin.

In some aspects, the techniques described herein relate to a firearm, wherein the pin includes a pin head and a pin body, wherein the pin head can be operably engaged with a screwdriver.

In some aspects, the techniques described herein relate to a firearm, wherein the member recess is itself within a barrel recess on the frame.

In some aspects, the techniques described herein relate to a firearm, wherein the sight block is included of at least one selected from the group of steel, polymer, and carbon fiber.

In some aspects, the techniques described herein relate to a firearm, wherein the pin connector member recess overlaps with a barrel recess on the frame.

In some aspects, the techniques described herein relate to a firearm, wherein the block member and the block member recess include a dovetail attachment mechanism.

In some aspects, the techniques described herein relate to a firearm, wherein the pin connector member and the pin connector member recess include a mortise and tenon attachment mechanism, wherein the pin connector member is the mortise and the pin connector member recess is the tenon.

In some aspects, the techniques described herein relate to a firearm, wherein removing the pin from the pin connector will release the pin connector member from the pin connector member recess.

In some aspects, the techniques described herein relate to a sight block including: a block member configured to removably attach to a block member recess in a firearm frame; a barrel hole; a pin hole below the barrel hole; a pin connector hole running through the block member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

Although embodiments of the present invention have been described herein in the context of a particular implementation in a particular environment for a particular purpose, those skilled in the art will recognize that its usefulness is not limited thereto and that the embodiments of the present invention can be beneficially implemented in other related environments for similar purposes. The invention should therefore not be limited by the above described embodiments, method, and examples, but by all embodiments within the scope and spirit of the invention as claimed.

Further, it is to be understood that the terminology used herein is for the purpose of describing particular embodiments only and is not intended to be limiting. The terms "a" or "an" as used herein, are defined as one or more than one. The term "plurality" as used herein, is defined as two or more than two. The term "another" as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper," "lower," "left," "rear," "right," "front," "vertical," "horizontal," and derivatives thereof relate to the invention as oriented in the figures and is not to be construed as limiting any feature to be a particular orientation, as said orientation may be changed based on the user's perspective of the device.

In the invention, various embodiments have been described with references to the accompanying drawings. It may, however, be evident that various modifications and changes may be made thereto, and additional embodiments may be implemented, without departing from the broader scope of the invention as set forth in the claims that follow. The invention and drawings are accordingly to be regarded in an illustrative rather than restrictive sense.

The invention is not to be limited in terms of the particular embodiments described herein, which are intended as illustrations of various aspects. Many modifications and variations can be made without departing from its spirit and scope. Functionally equivalent systems, processes and apparatuses within the scope of the invention, in addition to those enumerated herein, may be apparent from the representative descriptions herein. Such modifications and variations are intended to fall within the scope of the appended claims. The invention is to be limited only by the terms of the appended claims, along with the full scope of equivalents to which such representative claims are entitled.

The preceding description of exemplary embodiments provides non-limiting representative examples referencing numerals to particularly describe features and teachings of different aspects of the invention. The embodiments described should be recognized as capable of implementation separately, or in combination, with other embodiments from the description of the embodiments. A person of ordinary skill in the art reviewing the description of embodiments should be able to learn and understand the different described aspects of the invention. The description of embodiments should facilitate understanding of the invention to such an extent that other implementations, not specifically covered but within the knowledge of a person of skill in the art having read the description of embodiments, would be understood to be consistent with an application of the invention.

What is claimed is:

1. A firearm comprising:
- a frame comprising a block member recess and a pin connector member recess;
- a barrel;
- a slide; and
- a sight block comprising:
  - a block member configured to removably attach to the block member recess;
  - a barrel hole;
  - a pin hole below the barrel hole;
  - a pin connector hole running through the member and into the pin hole; and
  - a pin and a pin connector,
    - wherein the pin connector is threaded through the pin connector hole and the pin is threaded through the pin hole, wherein the pin removably attaches to the pin connector in the pin hole, and
    - wherein the sight block with the pin and the pin connector attached can removably attach to the frame by connecting the member to the member recess and the pin connector to the pin connector recess.

2. The firearm of claim 1, wherein the pin is a threaded screw, bolt, or rod.

3. The firearm of claim 2, wherein the pin connector is threaded to receive the pin.

4. The firearm of claim 3, wherein the pin comprises a pin head and a pin body, wherein the pin head can be operably engaged with a screwdriver.

5. The firearm of claim 1, wherein the sight block is configured to be covered by the slide while the firearm is assembled but not firing.

6. The firearm of claim 1, wherein the sight block is configured to remain in a fixed position while the firearm is firing.

7. The firearm of claim 1, wherein the sight block has beveled edges.

8. The firearm of claim 1, wherein the sight block has rounded edges.

9. The firearm of claim 1, wherein the sight block is comprised of at least one selected from the group of steel, polymer, and carbon fiber.

10. A firearm comprising:
- a frame comprising a block member recess and a pin connector recess;
- a sight block comprising:
  - a block member configured to removably attach to the block member recess;
  - a barrel hole;
  - a pin hole below the barrel hole;
  - a pin connector hole running through the block member and into the pin hole; and
  - a pin and a pin connector,
    - wherein the pin connector is threaded through the pin connector hole and the pin is threaded through the pin hole, wherein the pin removably attaches to the pin connector in the pin hole, and
    - wherein the sight block with the pin and the pin connector attached can removably attach to the frame by connecting the member to the member recess and the pin connector to the pin connector recess.

11. The firearm of claim 10, wherein the pin is a threaded screw, bolt, or rod.

12. The firearm of claim 10, wherein the pin connector is threaded to receive the pin.

13. The firearm of claim 10, wherein the pin comprises a pin head and a pin body, wherein the pin head can be operably engaged with a screwdriver.

14. The firearm of claim 10, wherein the member recess is itself within a barrel recess on the frame.

15. The firearm of claim 10, wherein the sight block is comprised of at least one selected from the group of steel, polymer, and carbon fiber.

16. The firearm of claim 10, wherein the pin connector member recess overlaps with a barrel recess on the frame.

17. The firearm of claim 10, wherein the block member and the block member recess comprise a dovetail attachment mechanism.

18. The firearm of claim 10, wherein the pin connector member and the pin connector member recess comprise a mortise and tenon attachment mechanism, wherein the pin connector member is the mortise and the pin connector member recess is the tenon.

19. The firearm of claim 10, wherein removing the pin from the pin connector will release the pin connector member from the pin connector member recess.

20. A sight block comprising:

a block member configured to removably attach to a block member recess in a firearm frame;

a barrel hole;

a pin hole below the barrel hole;

a pin connector hole running through the block member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

* * * * *